US009528528B2

(12) United States Patent
Wang et al.

(10) Patent No.: US 9,528,528 B2
(45) Date of Patent: Dec. 27, 2016

(54) INDUCED DRAUGHT FAN

(71) Applicant: Zhongshan Broad-Ocean Motor Co., Ltd., Zhongshan (CN)

(72) Inventors: Xiongcheng Wang, Zhongshan (CN); Wei Lei, Zhongshan (CN)

(73) Assignee: Zhongshan Broad-Ocean Motor Co., Ltd., Zhongshan (CN)

( * ) Notice: Subject to any disclaimer, the term of this patent is extended or adjusted under 35 U.S.C. 154(b) by 815 days.

(21) Appl. No.: 13/845,068

(22) Filed: Mar. 17, 2013

(65) Prior Publication Data

US 2013/0216377 A1 Aug. 22, 2013

Related U.S. Application Data

(63) Continuation-in-part of application No. PCT/CN2012/074793, filed on Apr. 27, 2012.

(30) Foreign Application Priority Data

Dec. 3, 2011 (CN) ..... 2011 2 0497688 U

(51) Int. Cl.
*F04D 29/10* (2006.01)
*F04D 29/12* (2006.01)
*F04D 29/42* (2006.01)

(52) U.S. Cl.
CPC ..... *F04D 29/102* (2013.01); *F04D 29/122* (2013.01); *F04D 29/4226* (2013.01)

(58) Field of Classification Search
CPC ..... F04D 29/083; F04D 29/086; F04D 29/10; F04D 29/102; F04D 29/104; F04D 29/106; F04D 29/108; F04D 29/12; F04D 29/122; F04D 29/126; F04D 29/16; F04D 29/161; F04D 29/162; F04D 29/165; F04D 29/167; F04D 29/4226; F04D 25/24; F16J 15/02; F16J 15/021; F16J 15/022; F16J 15/16; F16J 15/32; F16J 15/3204; F16J 15/322; F16J 15/3248; F16J 15/3252; G01L 19/007; G01L 19/0007; F01D 25/24
(Continued)

(56) References Cited

U.S. PATENT DOCUMENTS 2,598,484 A * 5/1952 Adams ..... F04D 29/126 277/348
2,636,442 A * 4/1953 Roth ..... F04D 29/18 415/203

(Continued)

*Primary Examiner* — Dwayne J White
*Assistant Examiner* — Su Htay
(74) *Attorney, Agent, or Firm* — Matthias Scholl, PC; Matthias Scholl

(57) ABSTRACT

An induced draught fan, including: a motor, the motor including a shaft; a volute; and a wind wheel. The volute is provided with an air intake and an air outlet. The wind wheel is arranged inside the volute. The top of the volute is provided with a through-hole. The shaft of the motor passes through the through-hole and is connected to the wind wheel. A seal ring is arranged on the volute corresponding to the through-hole. An outer side of the seal ring is provided with an annular groove. The volute is embedded in the annular groove. The middle of the seal ring is provided with a center hole. The middle of the side wall of the center hole is provided with a ring-like convex edge. The shaft passes through the center hole and contacts with the ring-like convex edge.

12 Claims, 13 Drawing Sheets

(58) Field of Classification Search
USPC ..... 415/118, 168.2, 168.3, 174.3, 203, 204, 415/206, 214.1, 230; 277/59, 600, 608, 277/626, 641
See application file for complete search history.

(56) References Cited

U.S. PATENT DOCUMENTS

| | | | | | |
|---|---|---|---|---|---|
| 2,743,951 | A * | 5/1956 | Ayres | F16J 15/3232 | 277/560 |
| 4,124,220 | A * | 11/1978 | Leone | F01L 3/08 | 123/188.6 |
| 4,313,609 | A * | 2/1982 | Clements | F16J 15/02 | 220/231 |
| 4,407,511 | A * | 10/1983 | Benton | F16H 25/2418 | 277/354 |
| 5,275,530 | A * | 1/1994 | Kujawa | F04D 29/102 | 277/411 |
| 5,839,374 | A * | 11/1998 | Conner | F04D 23/001 | 110/162 |
| 6,109,615 | A * | 8/2000 | Gildea | F16H 48/08 | 277/349 |
| 2008/0016966 | A1 * | 1/2008 | Jacobsen | G01L 19/0007 | 73/706 |

* cited by examiner

INDUCED DRAUGHT FAN

CROSS-REFERENCE TO RELATED APPLICATIONS

This application is a continuation-in-part of International Patent Application No. PCT/CN2012/074793 with an international filing date of Apr. 27, 2012, designating the United States, now pending, and further claims priority benefits to Chinese Patent Application No. 201120497688.0 filed Dec. 3, 2011. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

Field of the Invention

The invention relates to an induced draught fan.

Description of the Related Art

A traditional induced draught fan includes a motor, a volute, and a wind wheel. The top of the volute is provided with a through-hole. The shaft of the motor passes through the through-hole and is connected with the wind wheel. A gap between the shaft and the volute is positioned at the through-hole. Foreign matters such as dust are easy to enter the inside of the volute through the gap, which influences the normal operation of the wind wheel.

A manometric interface as a small component arranged on the side of the draught fan is a safety device which is small in size but plays a great role. The negative pressure value from the manometric interface is directly connected with an air-break switch which controls the operation or stop of the whole system. Different loads raise different requirements of the output values of the manometric interface. The traditional method meets the qualified output values of the manometric interface by changing the position of the manometric interface or changing the shape of the manometric interface, which makes the fan have a multi-structural manometric interface or a multi-position manometric interface. It greatly increases production cost and is disadvantageous for the quality control.

SUMMARY OF THE INVENTION

In view of the above-described problems, it is one objective of the invention to provide an induced draught fan which has advantages of a simple structure, easy installation procedures and a good seal effect in keeping foreign matters such as dust from entering into the inside of the volute and keeping the normal operation of the wind wheel.

To achieve the above objective, in accordance with one embodiment of the invention, there is provided an induced draught fan, comprising: a motor comprising a shaft; a volute; and a wind wheel. The volute is provided with an air intake and an air outlet. The wind wheel is arranged inside the volute. A top of the volute is provided with a through-hole. The shaft of the motor passes through the through-hole and is connected with the wind wheel. A seal ring is arranged on the volute corresponding to the through-hole. An outer side of the seal ring is provided with an annular groove. The volute is embedded in the annular groove. A middle of the seal ring is provided with a center hole. The middle of the side wall of the center hole is provided with a ring-like convex edge. The shaft passes through the center hole and contacts with the ring-like convex edge.

In a class of this embodiment, an inner wall of the through-hole is provided with a ring-like convex boss. The ring-like convex boss is embedded in the annular groove of the seal ring.

In a class of this embodiment, the outer side of the seal ring is provided with hooks which are clamped between ribs arranged on the top of the volute.

In a class of this embodiment, the top of the volute protrudes outward to form an annular edge at the edge of the through-hole. An inner side wall of the annular edge is provided with a ring-like convex block. The ring-like convex block is embedded in the annular groove of the seal ring.

In a class of this embodiment, the outer side of the seal ring is provided with convex lugs which are embedded in gaps arranged on the annular edge.

In a class of this embodiment, the seal ring is made of rubber.

In a class of this embodiment, the volute is provided with a manometric interface. A cavity for receiving the wind wheel is provided in the middle of the volute. The volute is provided with a first through-hole. A second through-hole is positioned in the middle of the manometric interface which is arranged on the volute. The second through-hole and the cavity communicate. An end face of the manometric interface protrudes to form a spoiler block which is positioned in the cavity and is capable of rotating with the manometric interface in a circumferential direction along the first through-hole.

In a class of this embodiment, a seal cover is provided at the first through-hole outside the manometric interface. The seal cover comprises a body comprising an installation hole in the middle. A slot is provided on the body outside the installation hole. The slot is embedded in the base board of the volute. The manometric interface is embedded in the installation hole and is capable of rotating in a circumferential direction along the installation hole.

In a class of this embodiment, the bottom of the body of the seal cover is equipped with a convex annular edge. The annular edge forms an installation cavity. A plurality of cut edges is provided on the annular edge outside the installation cavity. An installation plate is arranged on the outer side of the manometric interface. The outer side of the installation plate is provided with a plurality of cut edges. The installation plate is embedded in the installation cavity. The cut edges of the installation plate match with the cut edges of the annular edge.

In a class of this embodiment, the manometric interface is made by injection molding or of metal plates.

In a class of this embodiment, the spoiler block is an arc-shaped plate.

In a class of this embodiment, the seal cover is made of rubber.

Advantages of the invention are summarized as follows:

1) A seal ring is arranged on the volute corresponding to the through-hole. The outer side of the seal ring is provided with an annular groove. The volute is embedded in the annular groove. The middle of the seal ring is provided with a center hole. The middle of the wall of the center hole is provided with a ring-like convex edge. The shaft passes through the center hole and contacts with the ring-like edge. The invention has advantages of a simple structure, easy installation procedures and a good seal effect in keeping foreign matters such as dust from entering into the inside of the volute and keeping the normal operation of the wind wheel.

2) The outer side of the seal ring is provided with hooks which are clamped between the ribs on the top. The seal structure has reasonable and compact structural design.
3) The seal ring is made of rubber with low cost.
4) The end face of the manometric interface of the invention is provided with a spoiler block which is positioned in the cavity and is capable of rotating with the manometric interface in circumferential direction along the first through-hole. The structure is simple and suitable for different kinds of fans, which reduces the production cost. The spoiler block changes the airflow direction inside the manometric interface by the principle of the uneven airflow distribution to influence the negative pressure output values of the manometric interface. Different negative pressure output values are realized by changing the angle of the spoiler block of the manometric interface to meet the requirements of different fans in terms of the negative pressure output value of the manometric interface.
5) A seal cover is provided at the first through-hole on the outer side of the manometric interface. The seal cover comprises a body. The middle of the body is provided with a mounting hole. A slot is provided on the body outside the installation hole. The groove is embedded in the base board of the volute. The manometric interface is embedded in the installation hole and is capable of rotating in circumferential direction along the installation hole. The seal cover is suitable for volute fans with thinner side walls, which ensures that the manometric interface is capable of rotating in circumferential direction and have a good sealing effect.
6) The bottom of the body of the sealing cover is provided with a convex annular edge. The annular edge forms an installation cavity. A plurality of cut edges is provided on the annular edge outside the installation cavity. The outer side of the manometric interface is provided with a convex mounting plate. The outer side of the installation plate is provided with a plurality of cut edges of the installation plate. The installation plate is embedded in the installation cavity. The cut edges of the installation plate match with the cut edges of the annular edge. The cut edges of the installation plate make the spoiler block rotate in fixed angles, which is convenient for installation.

DETAILED DESCRIPTION OF THE EMBODIMENTS

For further illustrating the invention, experiments detailing an induced draught fan are described below. It should be noted that the following examples are intended to describe and not to limit the invention.

Example 1

Figure 1:
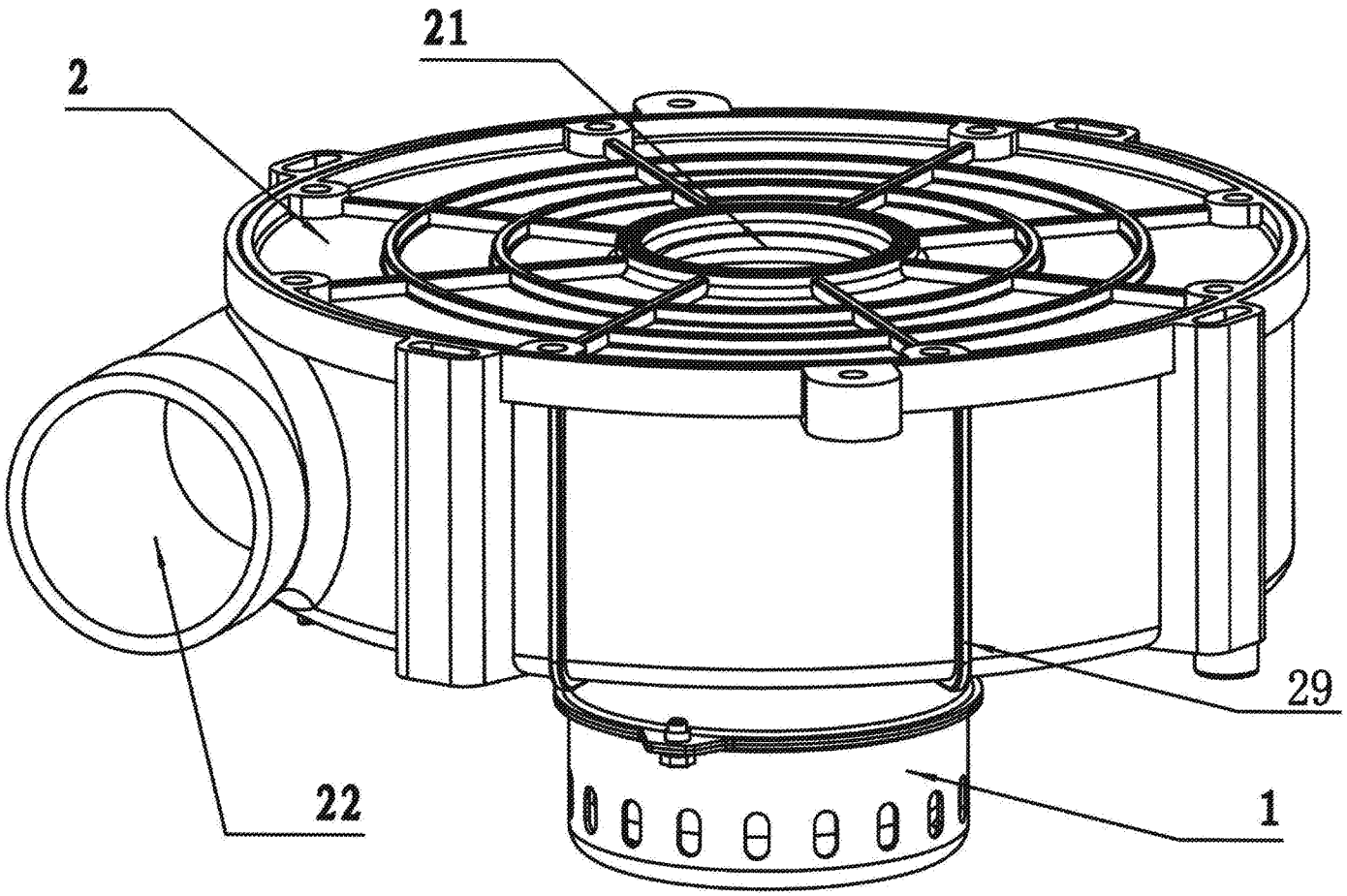
FIG. 1 is a three-dimensional diagram of an induced draught fan of the invention.
Figure 2:
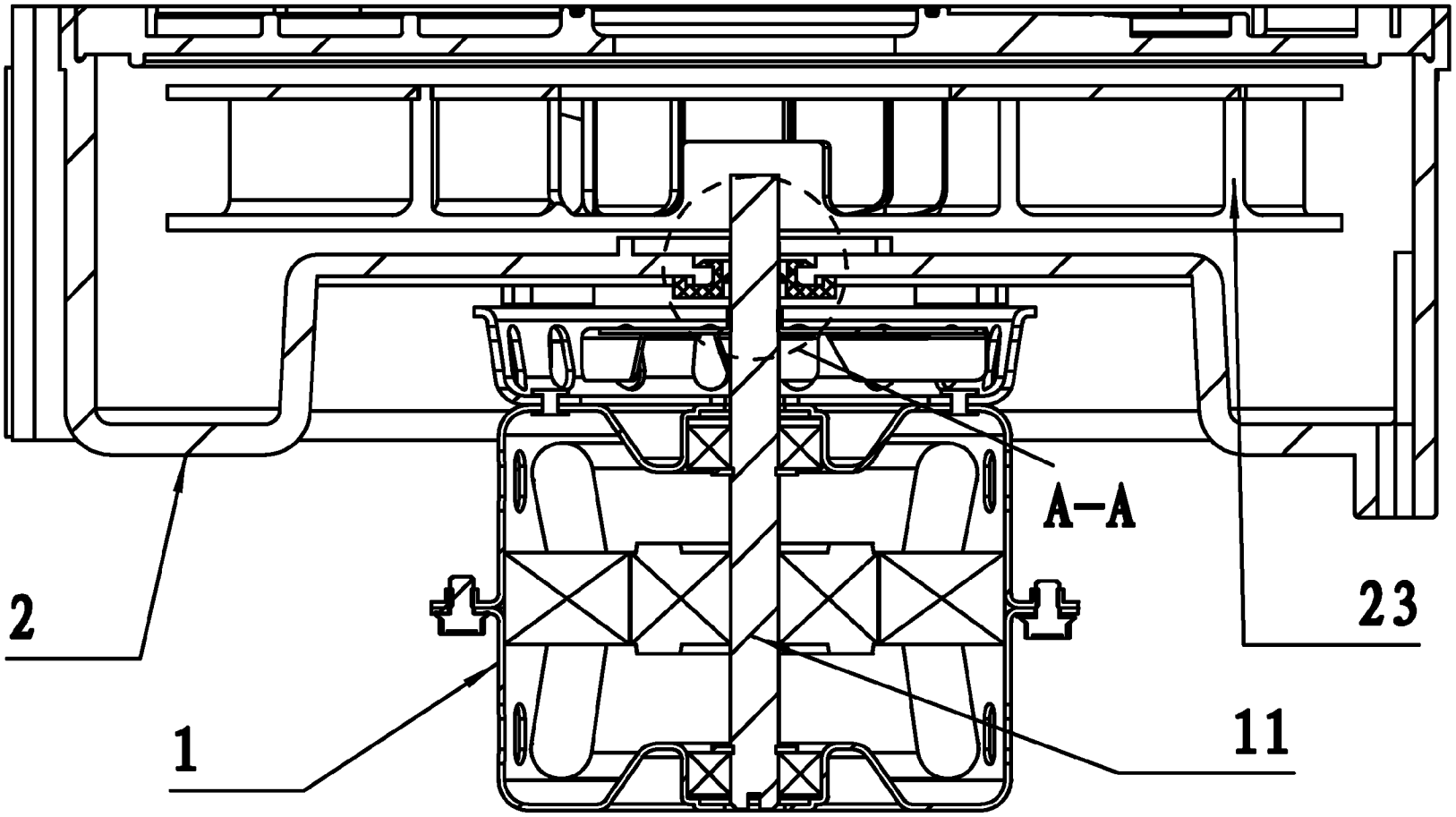
FIG. 2 is a sectional view of an induced draught fan of Example 1 of the invention.
Figure 3:
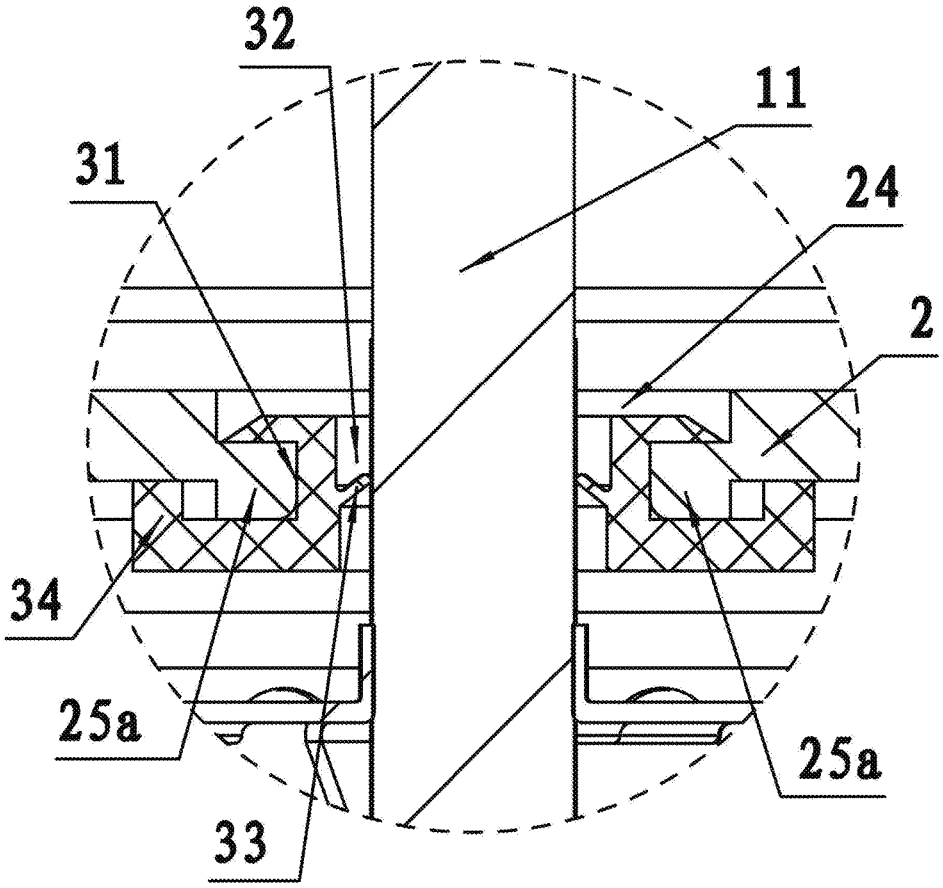
FIG. 3 is an enlarged view of part A-A of FIG. 2.
Figure 4:
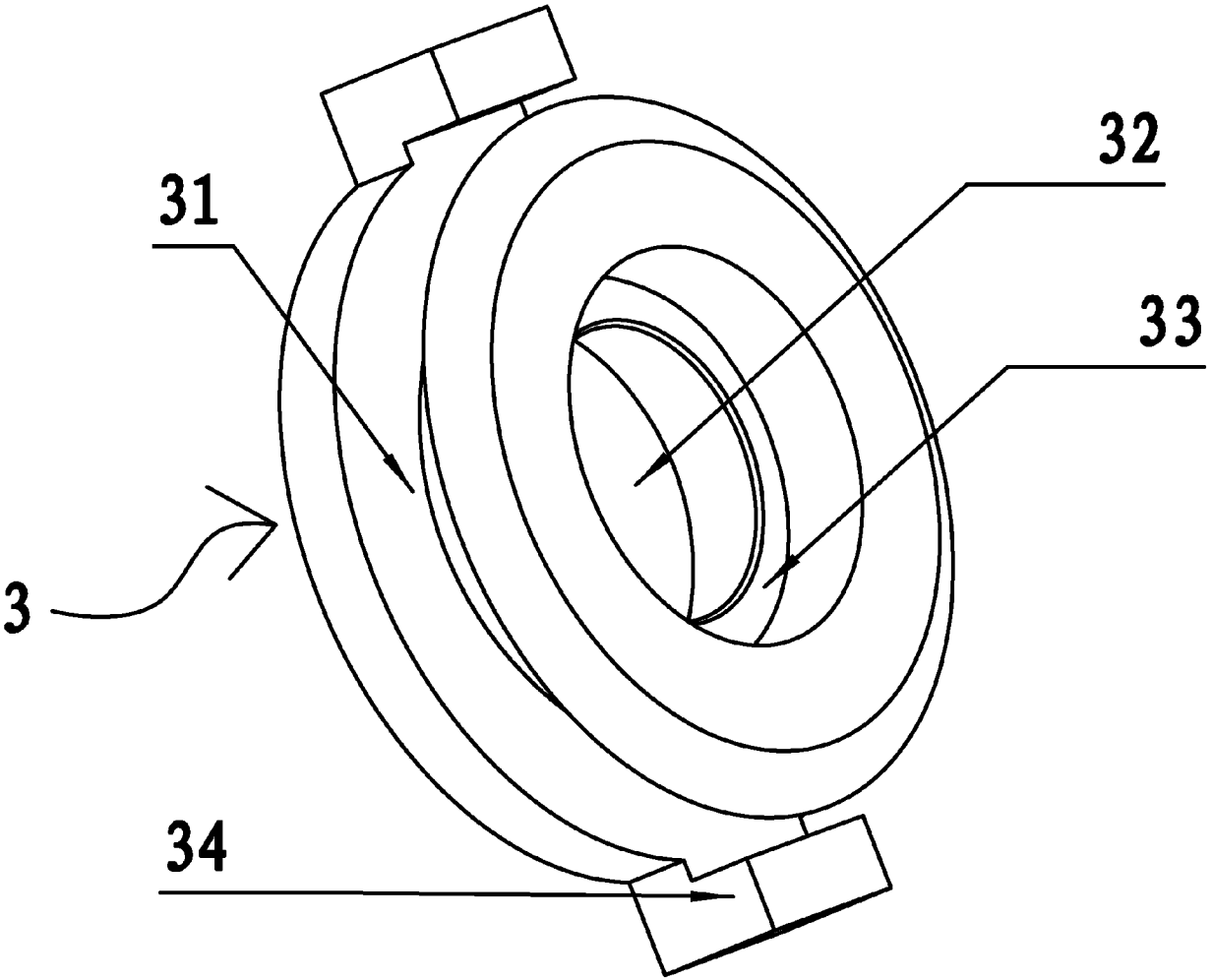
FIG. 4 is a three-dimensional diagram of a seal ring of Example 1 of the invention.

As shown in FIGS. 1-4, an induced draught fan comprises a motor 1, a volute 2, and a wind wheel 23. The volute 2 is provided with an air intake 21 and an air outlet 22. The wind wheel 23 is arranged inside the volute 2. The top of the volute 2 is provided with a through-hole 24. The shaft 11 of the motor 1 passes through the through-hole 24 and is connected with the wind wheel 23. A seal ring 3 is arranged on the volute 2 corresponding to the through-hole 24. The outer side of the seal ring 3 is provided with an annular groove 31. The volute 2 is embedded in the annular groove 31. The middle of the seal ring 3 is provided with a center hole 32. The middle of the side wall of the center hole 32 is provided with a ring-like convex edge 33. The shaft 11 passes through the center hole 32 and contacts with the ring-like convex edge 33. The inner wall of the through-hole 24 is provided with a ring-like convex boss 25*a*. The ring-like convex boss 25*a* is embedded in the annular groove 31 of the seal ring 3. The outer side of the seal ring 3 is provided with hooks 34 which are clamped between ribs 27 on the top of the volute 2. The seal ring 3 is made of rubber.

Example 2

Figure 5:
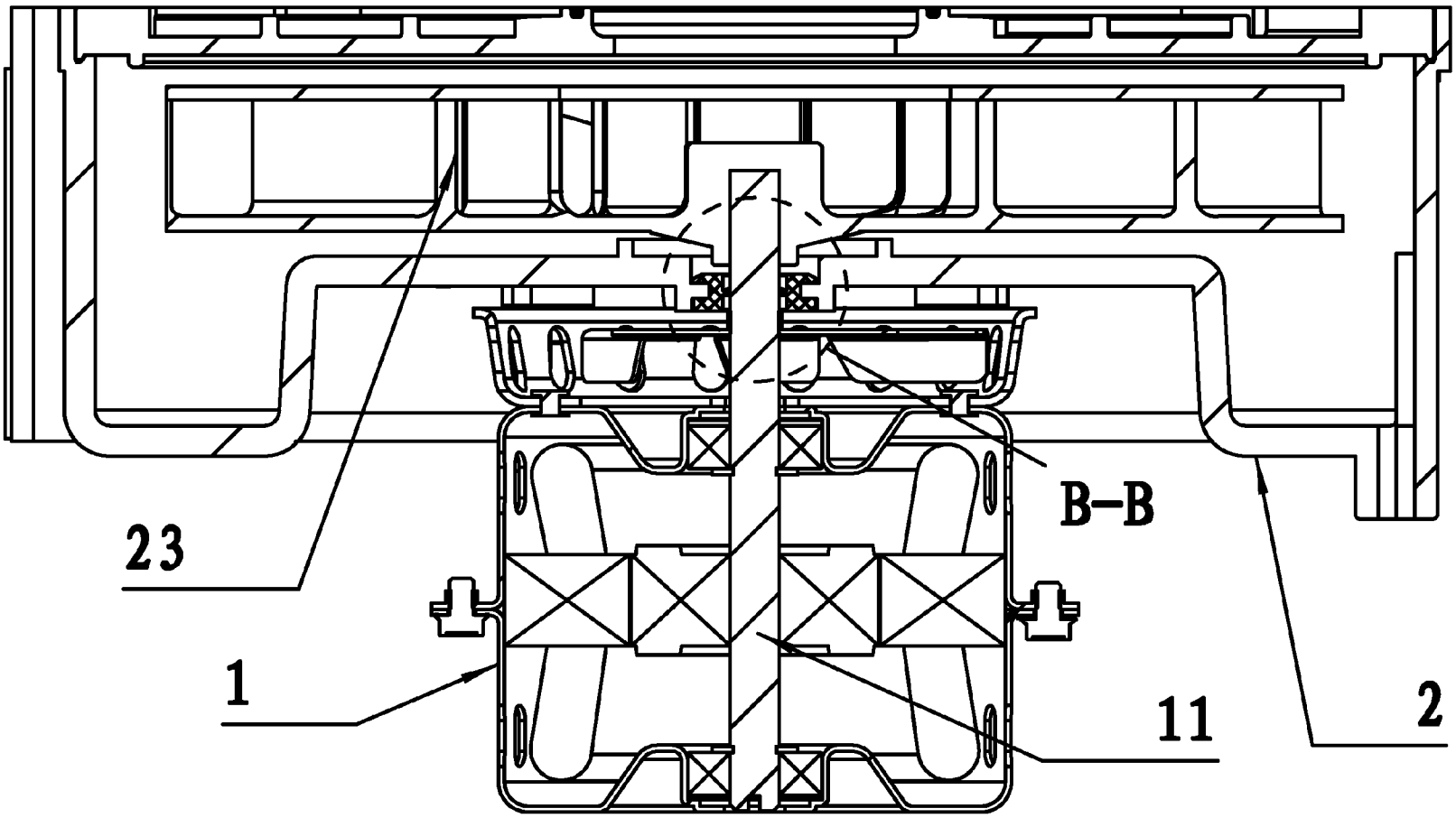
FIG. 5 is a sectional view of an induced draught fan of Example 2 of the invention.
Figure 6:
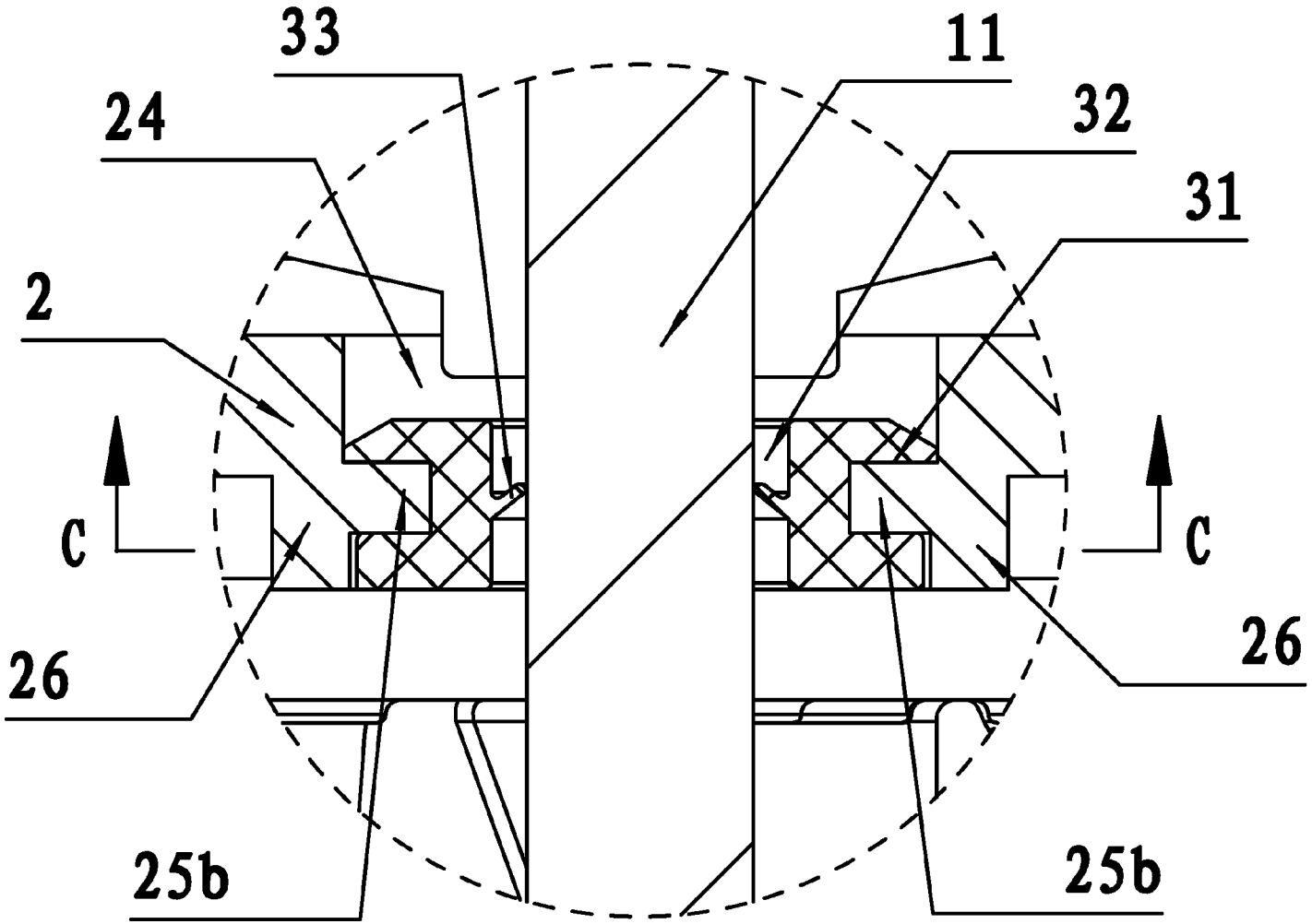
FIG. 6 is an enlarged view of part B-B of FIG. 5.
Figure 7:
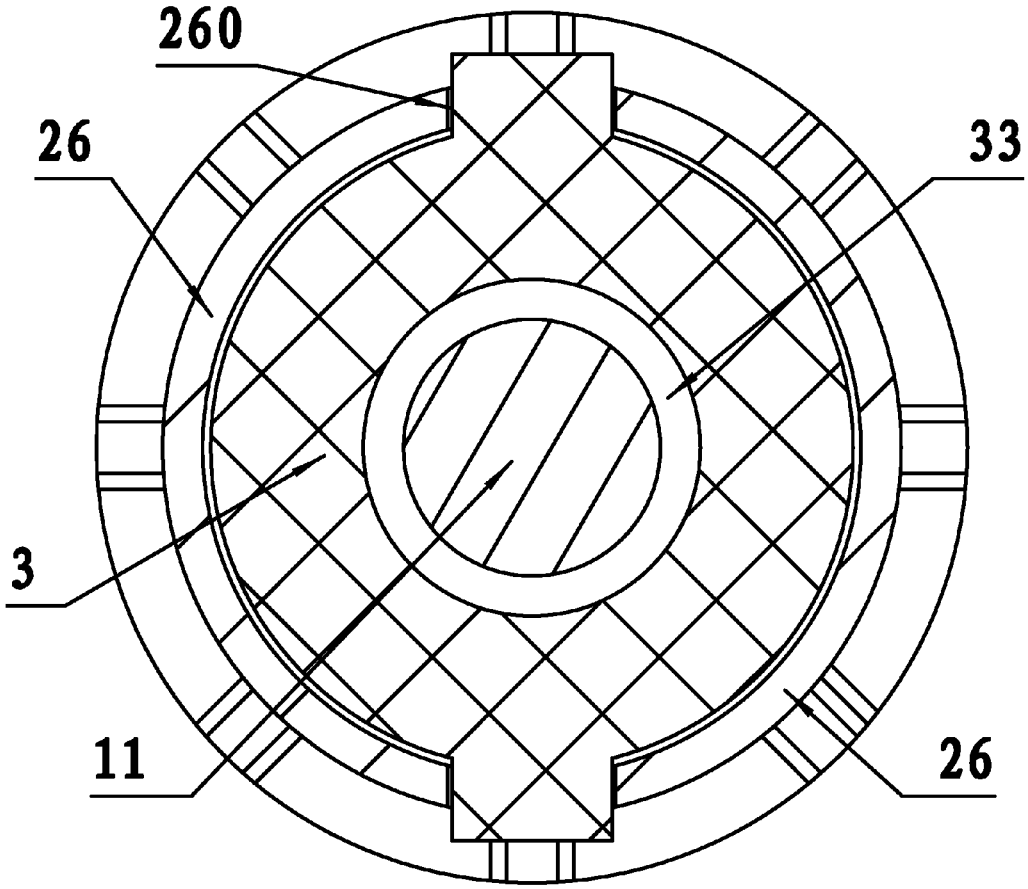
FIG. 7 is an exploded view of FIG. 6 taken from line C-C.
Figure 8:
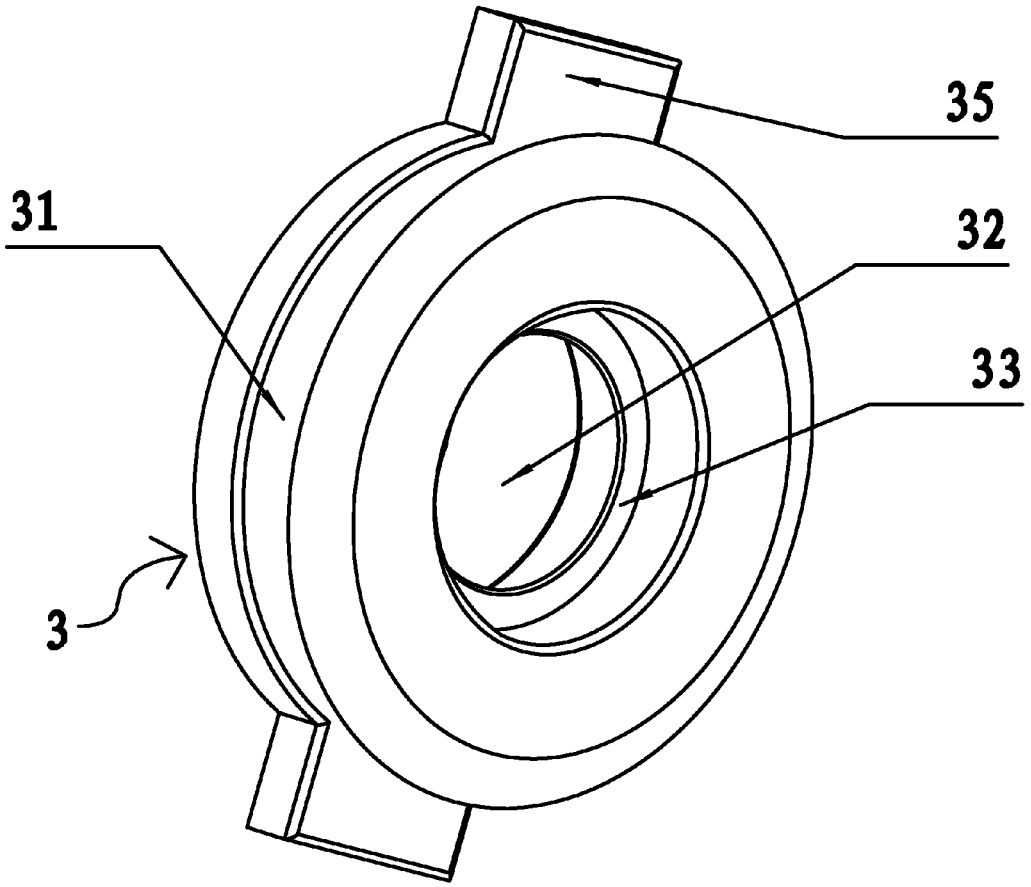
FIG. 8 is a three-dimensional diagram of a seal ring of Example 2 of the invention.

As shown in FIG. 1, FIG. 5, FIG. 6, FIG. 7, and FIG. 8, an induced draught fan comprises a motor 1, a volute 2, and a wind wheel 23. The volute 2 is provided with an air intake 21 and an air outlet 22. The wind wheel 23 is arranged inside the volute 2. The top of the volute 2 is provided with a through-hole 24. The shaft 11 of the motor 1 passes through the through-hole 24 and is connected with the wind wheel 23. The seal ring 3 is arranged on the volute 2 corresponding to the through-hole 24. The outer side of the seal ring 3 is provided with an annular groove 31. The volute 2 is embedded in the annular groove 31. The middle of the seal ring 3 is provided with a center hole 32. The middle of the side wall of the center hole 32 is provided with a ring-like convex edge 33. The shaft 11 passes through the center hole 32 and contacts with the ring-like convex edge 33. The top of the volute 2 protrudes outward to form an annular edge 26 at the edge of the through-hole 24. The inner side wall of the annular edge 26 is provided with a ring-like convex block 25*b*. The ring-like convex block 25*b* is embedded in the annular groove 31 of the seal ring 3. The outer side of the seal ring 3 is provided with convex lugs 35 which are embedded in gaps 260 arranged on the annular edge 26.

In the invention, the seal ring 3 is arranged on the volute 2 corresponding to the through-hole 24. The outer side of the seal ring 3 is provided with an annular groove 31. The volute 2 is embedded in the annular groove 31. The middle of the seal ring 3 is provided with a center hole 32. The middle of the wall of the center hole 32 is provided with a ring-like convex edge 33. The shaft 11 passes through the center hole 32 and contacts with the ring-like edge 33. The gap between the shaft and the volute is sealed to keep foreign matters from entering into the volute and keep the normal operation of the wind wheel.

Example 3

Figure 9:
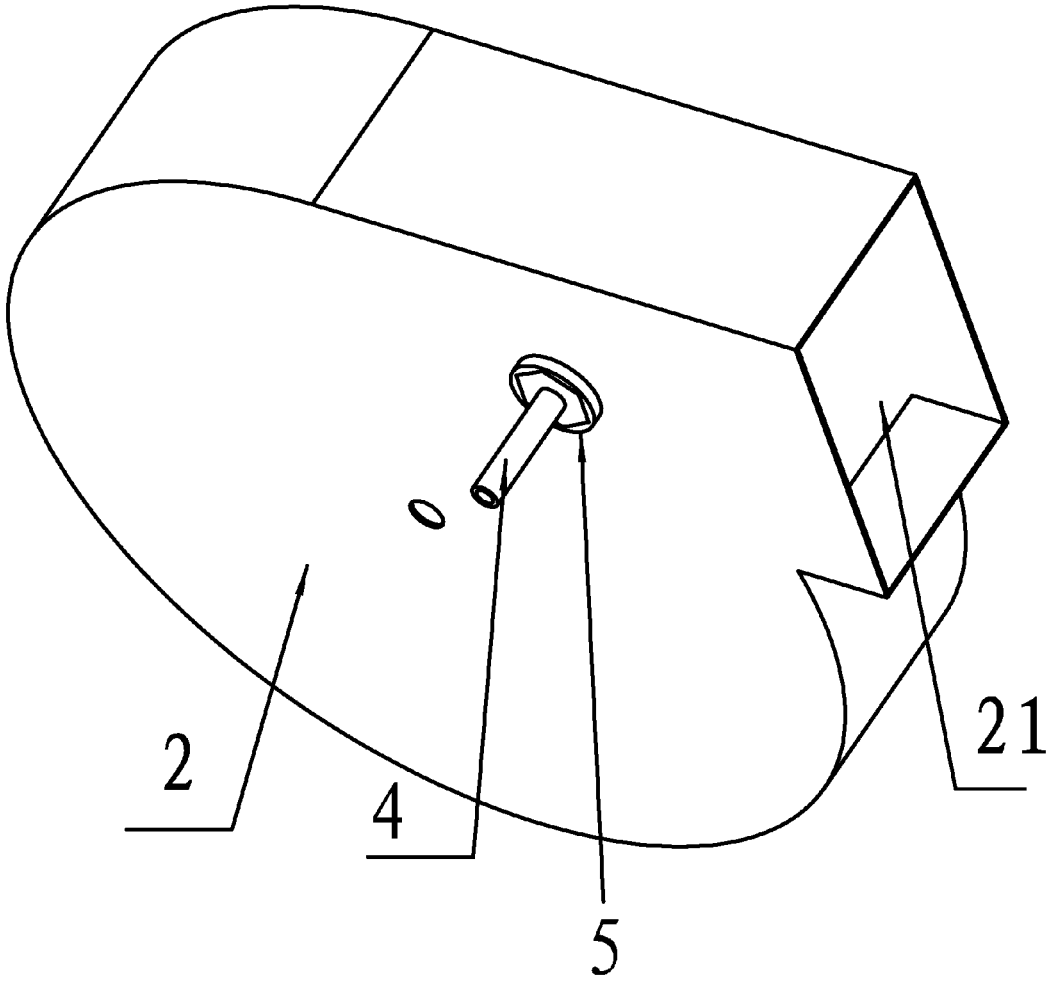
FIG. 9 is a schematic diagram of a manometric interface in accordance with one embodiment of the invention.
Figure 10:
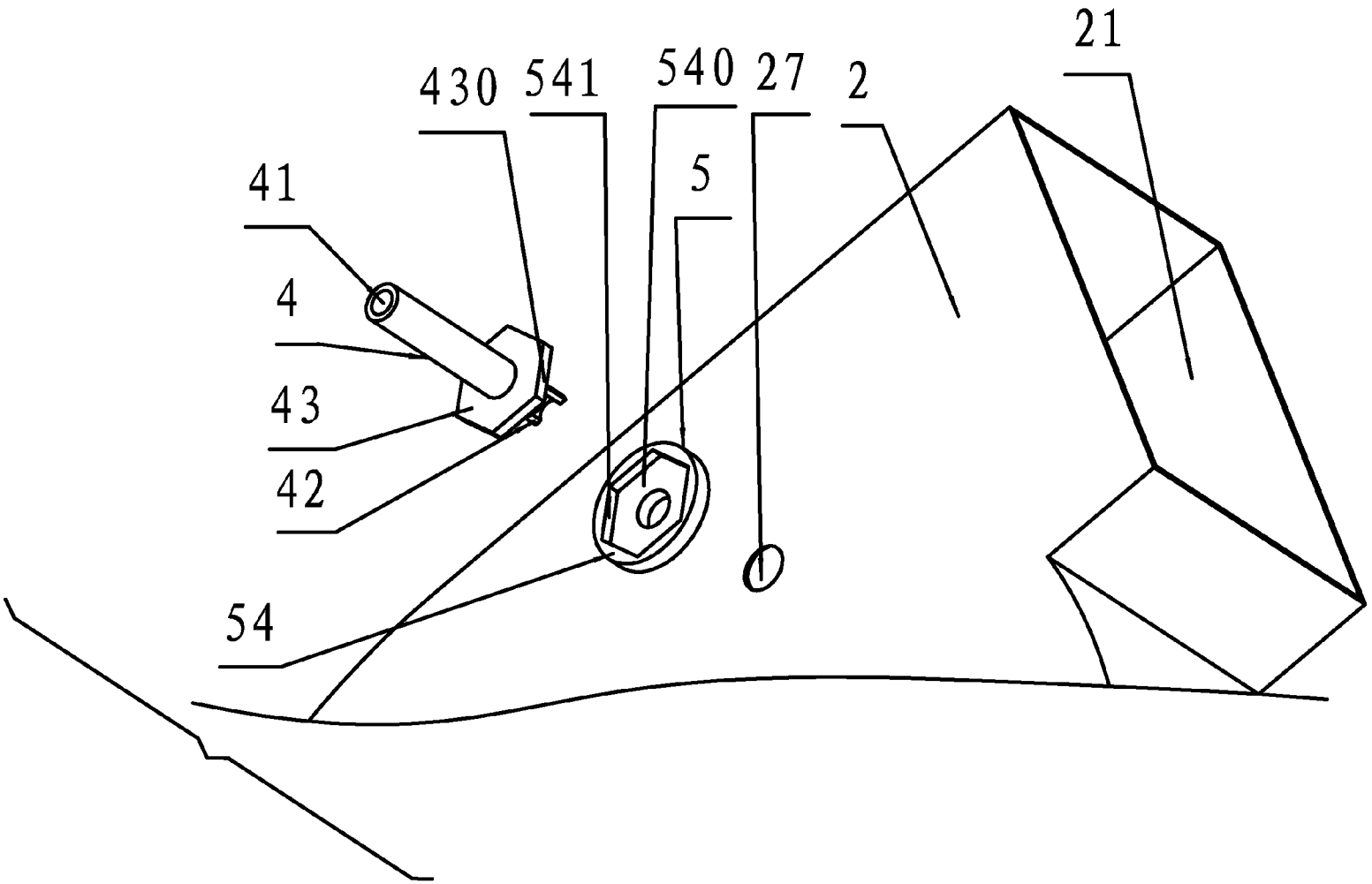
FIG. 10 is an exploded view of a manometric interface in accordance with one embodiment of the invention.
Figure 11:
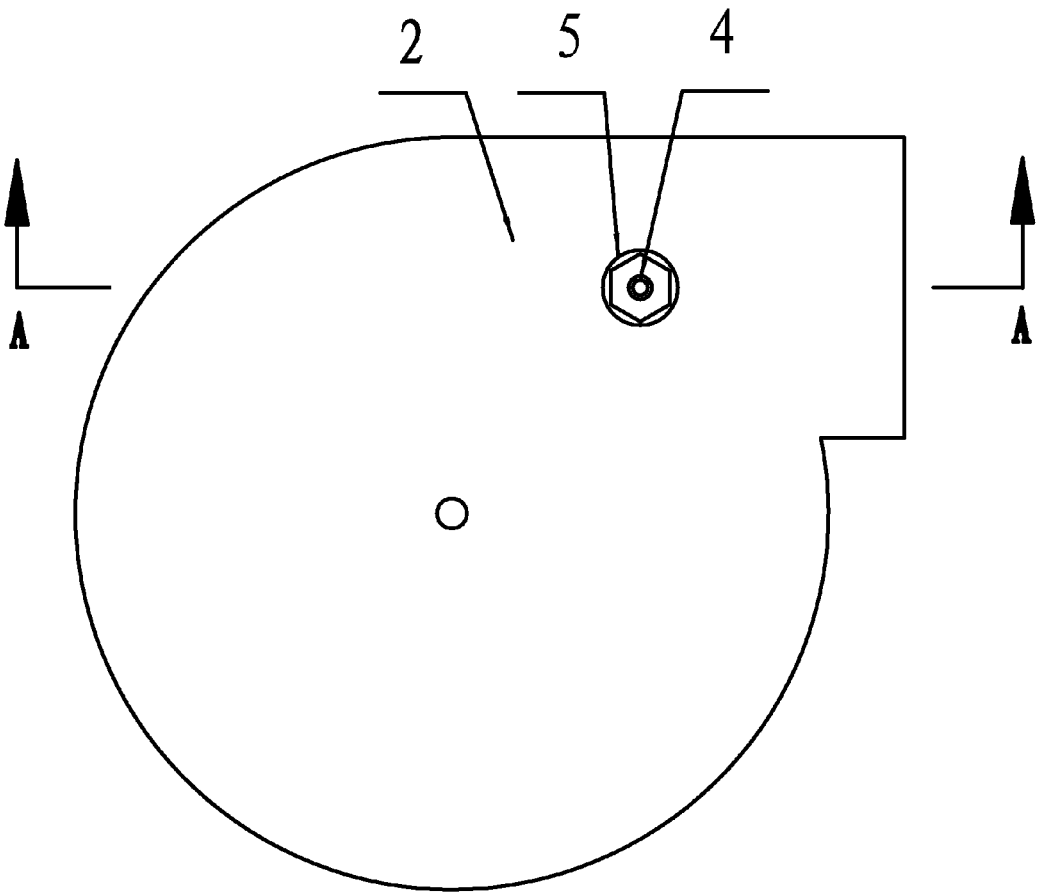
FIG. 11 is a schematic diagram of an induced draught fan having a manometric interface in accordance with one embodiment of the invention.
Figure 12:
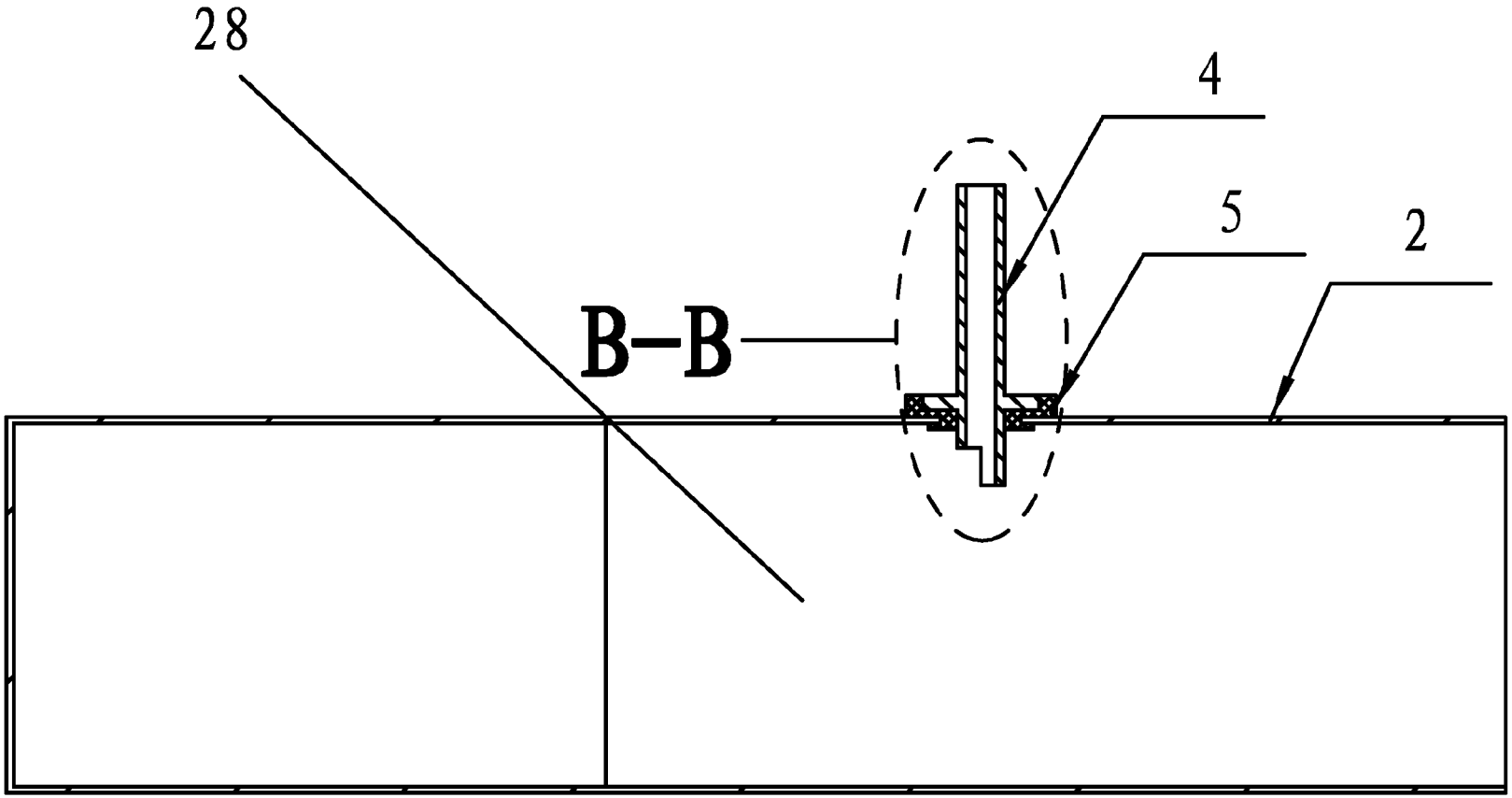
FIG. 12 is an exploded view of FIG. 11 taken from line A-A.
Figure 13:
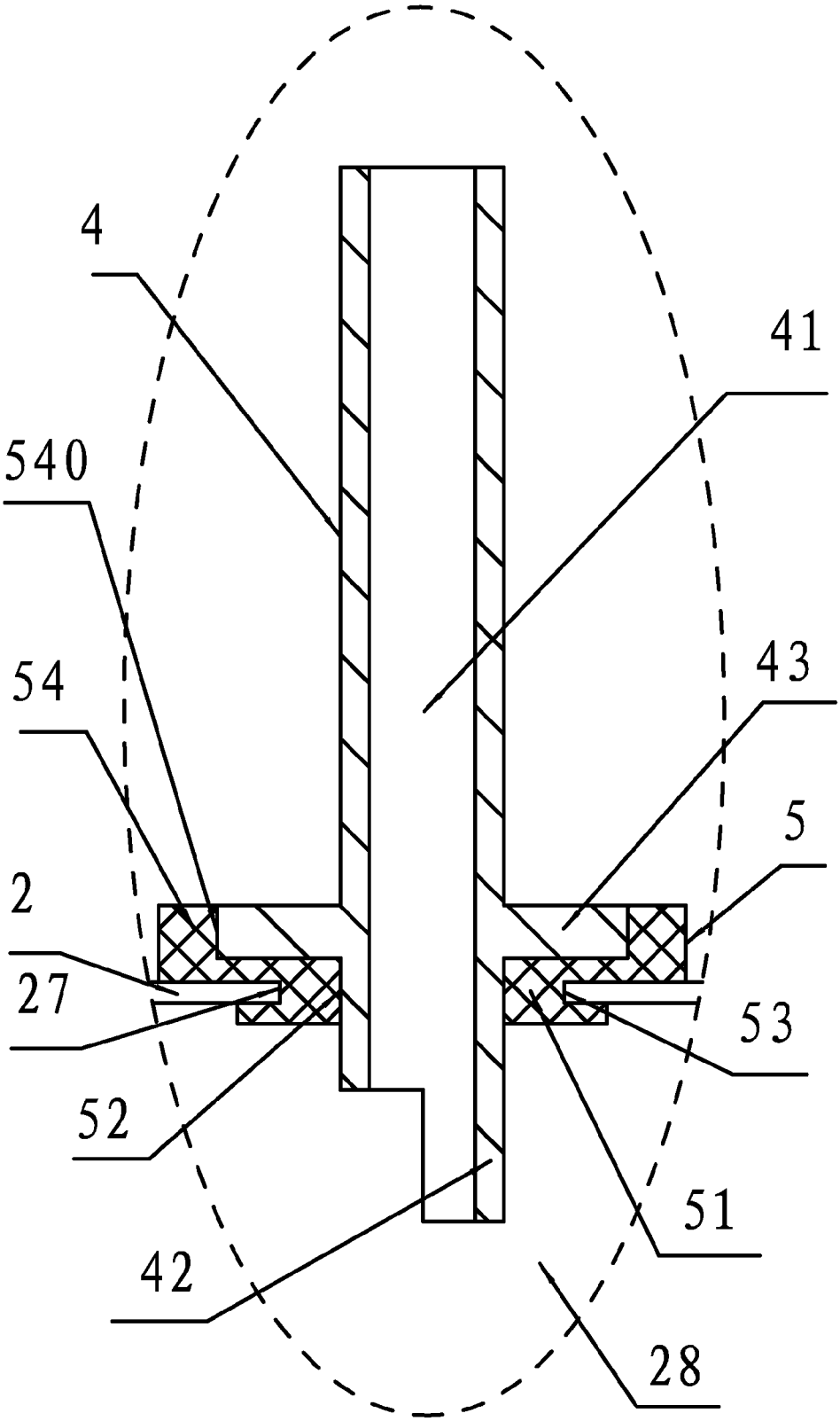
FIG. 13 is an enlarged view of part B-B of FIG. 12.

As shown in FIG. 9, FIG. 10, FIG. 11, FIG. 12 and FIG. 13, the volute 2 is provided with a manometric interface 4. A cavity 27 for receiving the wind wheel is provided in the middle of the volute. The volute 2 is provided with a first through-hole 28. A second through-hole 41 is positioned in the middle of the manometric interface 4 which is arranged on the volute 2. The second through-hole 41 and the cavity 27 communicate. The end face of the manometric interface 4 protrudes to form a spoiler block 42 which is positioned in the cavity 27 and is capable of rotating with the manometric interface 24 in circumferential direction along the first through-hole 28. A seal cover 5 is provided at the first through-hole 28 outside the manometric interface 4. The seal cover 5 comprises a body 51 comprising an installation hole 52 in the middle. The slot 53 is provided on the body 51 outside the installation hole 52. The slot 53 is embedded in the base board of the volute 2. The manometric interface 4 is embedded in the installation hole 52 and is capable of rotating in circumferential direction along the installation hole 52. The bottom of the body 51 of the seal cover 5 is equipped with a convex annular edge 54. The annular edge 54 forms an installation cavity 540. A plurality of cut edges 541 is provided on the annular edge 54 outside the installation cavity 540. An installation plate 43 is arranged on the outer side of the manometric interface 4. The outer side of the installation plate 43 is provided with a plurality of cut edges 430. The installation plate 43 is embedded in the installation cavity 540. The cut edges 430 of the installation plate match with the cut edges 541 of the annular edge. The manometric interface 4 is made by injection molding or of metal plates. The spoiler block 42 is an arc-shaped plate. The seal cover is made of rubber.

The induced draught fan influences the negative pressure output values of the manometric interface 4 by changing the even structure of the end part of the traditional manometric interface and providing the spoiler block 42 on the end surface of the manometric interface 4 which changes the air flow direction in the manometric interface 4 by the principle of the uneven air-flow distribution. Different negative pressure output values are realized by changing the angle of the spoiler block of the manometric interface through rotation to meet the requirements of different fans in terms of the negative pressure output value of the manometric interface. When the spoiler block 42 is rotated close to the air outlet to the maximum extent the negative pressure output value is the smallest, which is smaller than the negative pressure output value as no spoiler block is provided. When the spoiler block 42 is rotated away from the air outlet to the maximum extent the negative pressure output value is the largest, which is larger than the negative pressure output value as no spoiler block is provided.

The invention claimed is:

1. An induced draught fan, comprising:

a) a motor comprising a shaft;

b) a volute; and c) a wind wheel;

wherein:

the volute is provided with an air intake and an air outlet;

the wind wheel is arranged inside the volute;

a top of the volute is provided with a through-hole;

the shaft of the motor passes through the through-hole and is connected with the wind wheel;

a seal ring is arranged on the volute corresponding to the through-hole;

an outer side of the seal ring is provided with an annular groove;

an inner wall of the through-hole is provided with a ring-like convex boss;

the ring-like convex boss is embedded in the annular groove of the seal ring;

the volute is embedded in the annular groove;

a middle of the seal ring is provided with a center hole confined by a side wall;

a middle of the side wall is provided with a ring-like convex edge; and the shaft passes through the center hole and contacts with the ring-like convex edge;

the outer side of the seal ring is provided with hooks which are clamped between ribs arranged on the top of the volute;

the volute is provided with a manometric interface;

a cavity for receiving the wind wheel is provided in a middle of the volute;

the volute is provided with a first through-hole;

a second through-hole is positioned in a middle of the manometric interface which is arranged on the volute;

the second through-hole and the cavity communicate; and an end face of the manometric interface protrudes to form a spoiler block which is positioned in the cavity and is capable of rotating with the manometric interface in circumferential direction along the first through-hole.

2. An induced draught fan, comprising:

a) a motor comprising a shaft;

b) a volute; and c) a wind wheel;

wherein:

the volute is provided with an air intake and an air outlet;

the wind wheel is arranged inside the volute;

a top of the volute is provided with a through-hole;

the shaft of the motor passes through the through-hole and is connected with the wind wheel;

a seal ring is arranged on the volute corresponding to the through-hole;

an outer side of the seal ring is provided with an annular groove;

the volute is embedded in the annular groove;

a middle of the seal ring is provided with a center hole confined by a side wall;

a middle of the side wall is provided with a ring-like convex edge;

the shaft passes through the center hole and contacts with the ring-like convex edge;

the top of the volute protrudes outward to form an annular edge at an edge of the through-hole;

an inner side wall of the annular edge is provided with a ring-like convex block;

the ring-like convex block is embedded in the annular groove of the seal ring;

the volute is provided with a manometric interface;

a cavity for receiving the wind wheel is provided in a middle of the volute;

the volute is provided with a first through-hole;

a second through-hole is positioned in a middle of the manometric interface which is arranged on the volute;

the second through-hole and the cavity communicate; and an end face of the manometric interface protrudes to form a spoiler block which is positioned in the cavity and is capable of rotating with the manometric interface in circumferential direction along the first through-hole.

3. The induced draught fan of claim 1, wherein a seal cover is provided at the first through-hole and the seal cover encloses an outer surface of the manometric interface:

the seal cover comprises a body, wherein the body comprises an installation hole in a middle of the body;

a slot is provided on an outer wall of the body;

the slot is embedded in a base board of the volute; and the manometric interface is embedded in the installation hole and is capable of rotating in circumferential direction along the installation hole.

4. The induced draught fan of claim 2, wherein a seal cover is provided at the first through-hole and the seal cover encloses an outer surface of the manometric interface;

the seal cover comprises a body, wherein the body comprises an installation hole in a middle of the body;

a slot is provided on an outer wall of the body;

the slot is embedded in a base board of the volute; and the manometric interface is embedded in the installation hole and is capable of rotating in circumferential direction along the installation hole.

5. The induced draught fan of claim 3, wherein a bottom of the body of the seal cover is equipped with a convex annular edge;

the annular edge forms an installation cavity;

a first plurality of cut edges is provided on an inner wall of the annular edge;

an installation plate protrudes from the outer surface of the manometric interface;

an outer surface of the installation plate is provided with a second plurality of cut edges;

the installation plate is embedded in the installation cavity; and the second plurality of cut edges respectively matches with the first plurality of cut edges.

6. The induced draught fan of claim 4, wherein a bottom of the body of the seal cover is equipped with a convex annular edge;

the annular edge forms an installation cavity;

a first plurality of cut edges is provided on an inner wall of the annular edge;

an installation plate protrudes from the outer surface of the manometric interface;

an outer surface of the installation plate is provided with a second plurality of cut edges;

the installation plate is embedded in the installation cavity; and the second plurality of cut edges respectively matches with the first plurality of cut edges.

7. The induced draught fan of claim 1, wherein the manometric interface is made by injection molding or of metal plates.

8. The induced draught fan of claim 2, wherein the manometric interface is made by injection molding or of metal plates.

9. The induced draught fan of claim 1, wherein the spoiler block is an arc-shaped plate.

10. The induced draught fan of claim 2, wherein the spoiler block is an arc-shaped plate.

11. The induced draught fan of claim 3, wherein the seal cover is made of rubber.

12. The induced draught fan of claim 4, wherein the seal cover is made of rubber.

* * * * *